US007004545B2

(12) United States Patent
Miller

(10) Patent No.: US 7,004,545 B2
(45) Date of Patent: Feb. 28, 2006

(54) DEVICE AND METHOD FOR HEAD RESTRAINT

(76) Inventor: Scott D. Miller, 1800 Garden St., W. Lafayette, IN (US) 47906

( * ) Notice: Subject to any disclaimer, the term of this patent is extended or adjusted under 35 U.S.C. 154(b) by 0 days.

(21) Appl. No.: 10/855,062

(22) Filed: May 26, 2004

(65) Prior Publication Data

US 2004/0245832 A1 Dec. 9, 2004

Related U.S. Application Data

(60) Provisional application No. 60/475,752, filed on Jun. 4, 2003, provisional application No. 60/505,771, filed on Sep. 24, 2003.

(51) Int. Cl.
*A47C 7/38* (2006.01)

(52) U.S. Cl. ..... 297/393

(58) Field of Classification Search ..... 297/394, 297/393, 397, 230.12, 230.13
See application file for complete search history.

(56) References Cited

U.S. PATENT DOCUMENTS

| | | | | |
|---|---|---|---|---|
| 382,949 | A | 5/1888 | Campbell | |
| 443,764 | A * | 12/1890 | Hilliard | 602/19 |
| 2,973,030 | A | 2/1961 | Matthewson | |
| 3,101,973 | A | 8/1963 | Toth | |
| 3,151,343 | A | 10/1964 | McCormick | |
| 3,611,454 | A | 10/1971 | Klippel | |
| 3,707,734 | A | 1/1973 | Matthews | |
| 3,732,863 | A | 5/1973 | Harrington | |
| 3,737,923 | A | 6/1973 | Prolo | |
| 3,856,349 | A * | 12/1974 | Light | 297/230.12 |
| 3,889,668 | A | 6/1975 | Ochs et al. | |
| 4,161,946 | A | 7/1979 | Zuesse | |
| 4,182,322 | A | 1/1980 | Miller | |
| 4,183,583 | A | 1/1980 | Zuesse | |
| 4,339,151 | A | 7/1982 | Riggs | |
| 4,560,201 | A | 12/1985 | Scott | |
| 4,679,263 | A * | 7/1987 | Honer | 297/393 |
| 4,707,031 | A | 11/1987 | Meistrell | |
| 5,081,714 | A | 1/1992 | Liu | |
| 5,395,158 | A | 3/1995 | Cordia | |
| 5,505,523 | A | 4/1996 | Wang | |
| 5,685,831 | A * | 11/1997 | Floyd | 602/19 |
| 5,803,542 | A * | 9/1998 | Insausti | 297/230.12 |
| 5,868,471 | A | 2/1999 | Graham et al. | |
| 6,209,959 | B1 | 4/2001 | Meye | |
| 6,266,825 | B1 | 7/2001 | Floyd | |
| 6,301,716 | B1 | 10/2001 | Ross | |
| 6,305,749 | B1 | 10/2001 | O'Connor et al. | |
| 6,431,651 | B1 | 8/2002 | Lee | |
| 6,532,611 | B1 | 3/2003 | Day | |
| 6,607,245 | B1 * | 8/2003 | Scher | 297/393 |
| 6,786,554 | B1 * | 9/2004 | Zahiri | 297/393 |
| 6,799,802 | B1 * | 10/2004 | Moran | 297/393 |
| 2004/0026979 | A1 | 2/2004 | Haddon | |

* cited by examiner

*Primary Examiner*—Peter R. Brown

(57) ABSTRACT

Disclosed is a device capable of supporting a user's head when the user is seated in an upright position. The present invention includes a head support device comprising a support apparatus capable of fitting comfortably between a user's back and a seat surface and a securing apparatus capable of holding the user's head, wherein the support apparatus provides a rigid or semi-rigid support when fitted between the user and the seat surface and the securing apparatus is capable of securing the user's head to the support apparatus.

16 Claims, 11 Drawing Sheets

DEVICE AND METHOD FOR HEAD RESTRAINT

CROSS REFERENCE TO RELATED APPLICATIONS

This application claims the priority of U.S. Patent Application Ser. No. 60/475,752, filed Jun. 4, 2003, and U.S. Patent Application Ser. No. 60/505,771, filed Sep. 24, 2003, each hereby incorporated by reference in their entirety.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

This invention relates to devices and methods that provide support for the head, neck and upper spine. In a preferred embodiment, the invention relates to devices and methods that will facilitate sleep or general comfort during travel or other activities that are performed in an upright or seated position.

2. Description of the Related Art

Travelers who are forced to sit for a period of time in an upright posture have long struggled with obtaining adequate neck and head support to ensure comfort. Particularly during travel in, for example, airplanes, cars/buses, or trains, a traveler may wish to sleep and this may prove difficult without adequate head support. However, head movement, particularly in the forward direction, may make sleep impossible or, at the very least, painful for some travelers. This is even more true for traveler's who have head injuries or neck injuries or the like or for infants or the elderly. Complicating the problem are various safety and space issues, particularly on airplanes, that limit the types of devices available to the traveler.

Numerous devices for restraining the motion of the head in emergency and general medical applications have been used over the years. These devices are generally used in conjunction with a body splint apparatus of some type (see, for example, U.S. Pat. No. 4,182,322, hereby incorporated by reference).

The following U.S. Pat. Nos. (hereby incorporated by reference) represent art known to the applicant and clearly illustrate the novelty of applicant's invention: U.S. Pat. Nos. 3,151,343, 3,732,863, 3,611,454, 3,737,923, 3,707,734, 3,889,668.

With respect to travelers, a neck pillow has been developed with a horseshoe-shaped collar which, quite often, is an inflatable structure and, more recently, has been filled with foam, feathers, or organic granular or bark-type materials (see, for example, U.S. Pat. No. 6,532,611 hereby incorporated by reference). The pillow, ideally, fits around the neck and sits on the shoulders thus somewhat minimizing hinging of the neck (such as might occur when a person nods off to sleep. However, while the travel pillows disclosed in the art provide some neck support, particularly in the side to side range of movement, the pillows provide poor support in stopping forward movement of the head and in generally keeping the head aligned with the spine. Such movement may be quite common in moving vehicles and may result in discomfort for the user. For example, U.S. Pat. No. 6,431,651 (hereby incorporated by reference) describes a neck support device for a vehicle car seat. However, this device also does not support the users head from forwardly moving.

U.S. Pat. No. 5,505,523 (hereby incorporated by reference) describes a horseshoe shaped cushion, which additionally comprises a strap capable of tightening the cushion against the users cheeks. However, this apparatus is cumbersome and uncomfortable and does not provide full support in the forward direction. In addition to horseshoe shaped pillows, other devices have been designed to provide head or neck support in the side-to-side direction. For example, U.S. Pat. Nos. 5,868,471 and 6,305,749 (hereby incorporated by reference) describe head supports that attach to a headrest and provide a surface on which the user may lay their head. However, these devices do not provide support in the forward direction.

Various devices have been described to address the problem of forward head movement during travel. For example, U.S. Pat. Nos. 4,339,151, 4,707,0316, 6,209,959 and 6,266,825 (hereby incorporated by reference) each describe various apparatus of head restraint. Various devices are sold commercially to provide head/neck support for the upright traveler. For example, the Snoozzzzz pillow is designed to secure to the headrest of a seat and then secure the head of the user to the pillow. However, common to all of these devices is the need to secure the user to the seat or head rest on which the user is seated. In general, these devices utilize a strap or other apparatus for providing a secure surface attached to the user's seat combined with an apparatus for securing the user's head to the secure surface. Particularly on airplanes, this is problematic because, for example, the straps or securing devices are clumsy and may entangle other passengers (particularly in an emergency situation). Further, the user may have difficulty releasing himself from the straps. Further, the straps or other apparatus for providing a secure surface may interfere with the passenger directly behind the user (for example, the strap may interfere with the entertainment screen which is often located on the seatback).

U.S. Pat. No. 2,973,030 describes a body fatigue relieving support. However, the device does not, for example, provide head/neck support in the forward direction.

U.S. Pat. No. 3,101,973 describes a headrest that can be supported between the back of the user and the seat on which they are seated. However, the device does not, for example, provide head/neck support in the forward direction.

U.S. Pat. No. 382,949 describes a headrest that is strapped to the body. However, the device does not provide head/neck support in the forward direction.

U.S. Pat. No. 4,560,201 describes a headrest for a sedentary traveler. The device comprises a flexible fabric tie that loops over the users head and pulls the users head backward and downward. However, in addition to the many obvious drawbacks of this device, the downward pressure it creates on the neck of the user may become uncomfortable.

U.S. Pat. Nos. 6,301,716 and 5,395,158 each describe head restraint devices for attaching to the back of a wheelchair.

U.S. Pat. No. 5,081,714 describes a vehicle internal safety belt. The device functions by securing the headrest of a vehicle to the head of the user.

U.S. Pat. No. 4,161,946 describes a head support for use in a reclining seat. However, the device functions by transmitting the pressure of forward movement of the head through a forehead engagement means to the nape of the neck and the sternum.

U.S. Pat. No. 4,183,583 describes a head support for use in a reclining seat. While the device may be designed to fit between the passenger and the seat on which they are sitting, the device relies on the forward movement of the head to rotate the device on an axis formed with the shoulder or upper back. This rotational movement forces the lower part of the device against the seat thus holding the device in place and supporting the head from moving forward. The device is designed with a restraining bar that meets the forehead and downward connecting apparatus, which attach to the back plate. However the device has several drawbacks. The device is clumsy and blocks the peripheral sight of the user. Further, the device is not suited for use in alternative sleeping positions such as against the corner where a seat meets a wall. Further, the device is not practical for use when the user wishes to turn their head to the side. Further, the connecting apparatus cannot be made integral to the support apparatus. Further, the user's head would have a tendency to bounce against the restraining bar. Further, the device does not secure the head in a position that correctly aligns the head with the spine.

U.S. Patent Application Serial No. 2004/0026979 describes a "vertical hammock and pillow" to aid in comfort during travel. However, the device is cumbersome and fails to provide the neck support of the instant invention.

The described deficiencies in the existing art are merely exemplary. Other serious deficiencies may also be present. Furthermore, none of these disclosures teach or suggest the advantages of the instant invention and none of the disclosed devices comprise the advantages of the instant invention.

BRIEF SUMMARY OF THE INVENTION

The present invention provides a device capable of securing the head of a user in, for example, an upright position without the need for securing the user to the seat in which they are seated. Further, the device does not rely on the forward movement of the user's head (i.e. towards the front of the vehicle) for functionality and can therefore be utilized by people who prefer to sleep with their head directed to the side while still supporting the head from moving downward (i.e. forward movement of the head which may be directed towards the side of the vehicle or front of the vehicle). Accordingly, the device does not require a downward connecting apparatus to connect the restraint apparatus to the back support. Further, in one embodiment the device is capable of maintaining the alignment of the neck and spine in a position that minimizes muscular stress by, for example, facilitating correct posture. Such posture may aid breathing, reduce snoring and generally ease neck tension.

Such a device comprises, for example, a support apparatus and a securing apparatus. The support apparatus comprises a comfortable but rigid surface that is placed between the user's back and the seat. The weight of the user would thus substantially immobilize the support apparatus in an upright position. The securing apparatus is capable of securing the user's head against the support apparatus. Accordingly, the device would be unobtrusive and would not interfere with other passengers. Further, the user would not be strapped to the seat but, instead, would be free to stand or lean forward in an emergency situation by bending at the waist or back or simply moving forward slightly to remove the weight from the support apparatus. In another embodiment, the securing apparatus and support apparatus are detachable and the device further comprises an attachment apparatus through which the support apparatus and securing apparatus may be attached in a reversible manner. Such a device may be of great value to, for example, commercial travelers who sit for long periods of time in seats or military personnel who may sit for long periods in uncomfortable settings or people who simply enjoy sleeping in a chair at home.

By facilitating proper breathing, the device may also reduce snoring and other undesirable sleep related activities.

DETAILED DESCRIPTION OF THE INVENTION

Figure 1A:
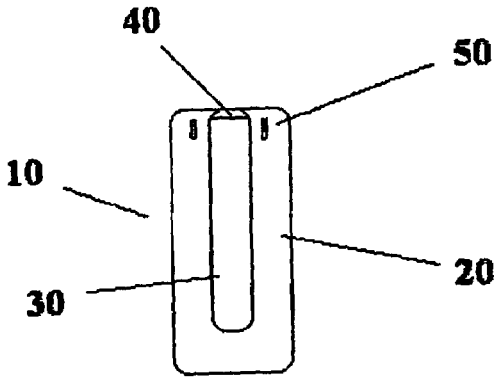
FIGS. 1A–E are views of several embodiments comprised in the instant invention.
Figure 1A:
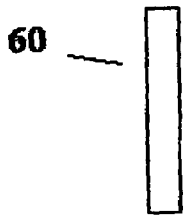

Unless otherwise defined, all technical and scientific terms used herein have the same meaning as commonly understood by one of ordinary skill in the art to which this invention belongs. Although methods and materials similar or equivalent to those described herein can be used in the practice or testing of the invention, suitable methods and materials are described below. All publications, patent applications, patents, and other references mentioned herein are incorporated by reference in their entirety. In the case of conflict, the present specification, including definitions, will control. In addition, the materials, methods, and examples are illustrative only and not intended to be limiting.

Seat as used herein refers to any object on which a user may sit but most commonly refers to, for example, vehicle seats. As would be obvious to one of ordinary skill in the art, a seat may also refer, for example, to the ground abutting a wall in which case a user would sit on the ground and lean against the wall.

As described above, the present invention provides a device capable of securing the head of a seated user in an upright position and, further, provides the individual elements utilized therein.

Such a device comprises, for example, a support apparatus and a securing apparatus.

The securing apparatus is capable of securing the head of the user. The securing apparatus secures the head of the user, for example, by circumnavigating the head of the user in some way that is both comfortable and does not interfere with the breathing of the user. The circumnavigation may be complete or partial.

In one embodiment, the securing apparatus contacts or wraps around the forehead of the user. In another embodiment, the securing apparatus contacts or wraps around the eyes of the user. In another embodiment the securing apparatus contacts or wraps around the nose of the user. In another embodiment, the securing apparatus contacts or wraps around the mouth or chin of the user. In another embodiment, the securing apparatus contacts or wraps around more than one area of the user.

In one embodiment, the first securing apparatus is made of a material constructed in such away that it is permeable and allows the user to breath through, for example, through breathing holes.

As would be apparent to one of skill in the art, the securing apparatus may comprise such materials as plastic, fabric, string, elastic, vinyl, leather etc.

In one embodiment, the securing apparatus is adjustable, for example, in length or width.

In one embodiment, the securing apparatus has some elasticity to provide the ability to stretch. In another embodiment, the securing apparatus does not have the ability to stretch.

In one embodiment, the securing apparatus is an eye blinder that fastens around the head of the user. In another embodiment, the securing apparatus comprises an eye blinder that may be, for example, folded down when desired while otherwise securing around the forehead. In another embodiment, the securing apparatus contacts mainly the front and sides of the head.

In another embodiment the first securing apparatus is a hat, for example a baseball hat, capable of fitting snugly on the head of the user. Because baseball hats commonly have an opening in the back, the support apparatus could thread through the opening thus attaching the securing apparatus to the support apparatus. Other attachment apparatus could be devised to attach the hat to the support apparatus as will be discussed in more detail below.

In one embodiment, the support apparatus is capable of being substantially immobilized between the user and the seating surface of the seat. In another embodiment, the support apparatus is capable of being substantially immobilized between the back of the user and the seating surface of the seat. In another embodiment, the support apparatus is capable of being substantially immobilized between the side of the user and the seating surface of the seat. In another embodiment, the support apparatus is capable of being substantially immobilized between the shoulder or arm of the user and the seating surface of the seat.

In one embodiment, the support apparatus is padded. In another embodiment, the support apparatus or padding thereby is shaped to fit the curve of a seat. In another embodiment, the support apparatus or padding thereby is adjustable to conform to the curve of the seat. In another embodiment, the support apparatus or padding thereby is adjustable to conform to the contours of the user. As would be apparent to one of skill in the art, the support apparatus can comprise materials such as plastic, fiberglass, metal, wood, cardboard, acrylic, rubber, foam, synthetics, etc. (characteristics of acrylic are summarized in Table 1). An additional material, for example, leather, vinyl, fabric, foam etc, may cover any aspect of the device. Such materials can function as padding, allow for easy cleaning, or simply be used aesthetically. In one embodiment, the material would be removable.

TABLE 1

Common Characteristics of PMMA Polymethylmethacrylate (Acrylic)*

| | |
|---|---|
| SPECIFIC DENSITY: | 1.16 |
| TENSILE STRENGTH (psi): | 7000 |
| FLEXURAL STRENGTH (psi): | 10500 |
| ELONGATION (%): | 48 |
| COMPR. STRENGTH (psi): | 11500 |
| FLEXURAL MODULUS (psi): | 310000 |

*Characteristics are representative of those known to one of skill in the art.

In one embodiment, the support apparatus is substantially rigid in the middle portion that runs along the spine of the user. In another embodiment, the support apparatus is rigid on the sides and is soft in the middle portion. In such an embodiment, the rigid sides could, for example, be outside the surface area of the user's back.

In one embodiment, the support apparatus comprises two rigid sides connected by fabric or other flexible material. In another embodiment, the support apparatus comprises multiple rods, which are either fixed together or may be inserted into a pocket, which holds them together. In another embodiment, the user may combine multiple support pieces until the desired rigidity is achieved. In one embodiment, the support comprises multiple shorter pieces, which overlap and become rigid when held in place by the user's weight. In one embodiment, the support comprises coiled springs or the like which may be bent or molded by the user to conform their shape. Such springs are described in the prior art, for example, in U.S. Patent Application No. 2004/0039316.

In one embodiment the support apparatus possesses some flexibility while not detracting from its ability to perform the intended purpose. In that sense, "rigid" may be defined as possessing sufficient rigidity to perform the described function of supporting the securing apparatus and thus supporting the user's head. Alternatively, rigid can mean "stiff" or "flexibly stiff". Alternatively, rigid may mean "resistant" or "flexibly resistant" or "resilient" or "flexibly resilient". In one embodiment, the rigidity of the support apparatus results in the head being restrained with a force similar to the force felt by the human head when a person lies horizontally on their back. Other definitions for rigid may be supplied by providing measurements related to the materials such that they would fall within a range of flexibility. Such information is available to one of skill in the art.

With respect to the support apparatus, width and thickness may be easily determined by one of skill in the art. In general, the width may be from mere millimeters to the full width of the seat depending on the rigidity and thickness of the material used. Preferred widths would be approximately between 2 cm and 15 cm. Thickness is generally from a millimeter or less to approximately 2 cm although any thickness that is comfortable and functional is envisioned.

In one embodiment, the support apparatus is of a length such that it performs the described function. Such a length may be determined by one of skill in the art based on the size of the user, for example, based on the distance between the top of the user's head and the middle or lower portion of the user's back. In another embodiment, the support apparatus, when extended, is between about twelve inches and about twenty inches. In another embodiment, the support apparatus, when extended, is between about fourteen inches and about eighteen inches. In another embodiment, the support apparatus, when extended, is about sixteen inches. The support may be further stabilized by a neckpiece or other device that would allow the overall length to be shortened.

In one embodiment, the support apparatus comprises an apparatus to prevent side-to-side movement or "slippage" of the support apparatus. In another embodiment, the apparatus for preventing slippage is increased surface area of the support apparatus. In a preferred embodiment, the increased surface area comprises, for example, fabric or other comfortable material extending from the rigid support. In one embodiment, the support apparatus would additionally comprise a belt, which attaches from a bottom portion of the support apparatus and attaches around the user. In one embodiment, the apparatus is designed to incorporate and airline pillow or airline blanket or any other item available on an aircraft.

In one embodiment, the device comprises a "compacting" apparatus that allows the device to be folded, collapsed or disassembled to a more compact size (i.e. for storage when not in use). In another embodiment, the compacting apparatus is a hinge (i.e. a locking hinge) that allows for folding and compact storage. In another embodiment, the compacting apparatus is a disassembly apparatus that allows for the support apparatus to be disassembled (i.e. reduced in length, width or depth or combinations thereof). Other envisioned embodiments for compacting are commonly utilized in the art (i.e. sliding mechanisms etc.) and are not expounded on here.

In another embodiment, the support apparatus comprises multiple adjoined segments capable of molding to the surface against which it is pressed. In another embodiment, the multiple adjoined segments are linked such that the pressure of an applied weight tightens the portion comprising the attachment apparatus and makes the support apparatus rigid in at least that portion of the support apparatus. In one such embodiment, the multiple segments are adjoined by a string or similar apparatus that is threaded through each segment. The top portion of the support apparatus would comprise interlocking segments that when pulled together by tension would form a solid or rigid support. Such an embodiment would enable the user to "roll" the device up into a compact form when not in use.

In one embodiment the rigidity of the support apparatus is such that the weight of the head in the forward or downward direction flexes the support apparatus between about zero inches and about 12 inches as measured from the axis created with the back to the top portion of the support. In another embodiment, the support apparatus is such that the weight of the head in the forward or downward direction is such that the support apparatus flexes between about zero inches and about 11, 10, 9, 8, 7, 6, 5, 4, 3, 2, 1 or less inches as measured from the axis created with the back (i.e. the vertical axis). Importantly, even when flexing, the device may relieve the neck and back by maintaining smooth support throughout the range of movement. In that respect, the support apparatus may be resilient but flexible. Accordingly, the rigidity, resiliency or flexibility is within a range that supports the function of the device. In essence, the device may, at a minimum, provide more support than would be experienced if the device were not used at all.

In one embodiment the rigid support apparatus is comprised within a cover or cover pocket. In another embodiment, the rigid support apparatus is comprised within a cover or cover pocket in which it is not fixed in place.

In one embodiment, the support apparatus is permanently associated with the securing apparatus.

In another embodiment, the support apparatus comprises an attachment apparatus for becoming reversibly associated with the securing apparatus. In a preferred embodiment, the apparatus for becoming reversibly associated is a loop or slot or other opening(s) through which the securing apparatus may be threaded. In another embodiment, the attachment apparatus may be Velcro. In one embodiment the securing apparatus is connected to the support apparatus by threading through two slots place a given distance (x) apart. Varying this distance x varies how much of the circumference of the head is contacted by the securing means. The distance between the slots would range from greater than zero inches to the approximate width of the apparatus comprising the slots. A distance of between about 2 inches and about 6 inches is a preferred embodiment.

In another embodiment, the support apparatus is of a size that remains substantially hidden behind the user and is unobtrusive.

In one embodiment, the attachment apparatus is a snap. In another embodiment, the attachment apparatus is Velcro. In another embodiment, the attachment apparatus is a hooking or similar apparatus and the second securing apparatus comprises the clasp or counterpart to the hooking apparatus. In another embodiment, the attachment apparatus is a button and a hole.

As is clear from the embodiments thus far described, the attachment apparatus may be comprised of at least two parts, which can be generally referred to as the "hooking" apparatus and the "clasping" apparatus. Therefore, in one embodiment, the securing apparatus comprises a hooking apparatus and the support apparatus comprises a clasping apparatus or vice versa. Accordingly, in this embodiment, the securing apparatus can be placed on the user and attached to the support apparatus.

In one embodiment, the invention provides a method for providing neck support to a user wherein the user utilizes the device of the instant invention. In another embodiment, the method is performed with the addition of a travel pillow or secondary comfort aid, for example, a horseshoe shaped pillow that may or may not be integral to the device. An advantage of utilizing the device of the instant invention in conjunction with such a pillow is that the device may actually hold the pillow in place by trapping the pillow between the neck or other part of the user and the device.

In one embodiment, the invention provides a head support device comprising a) a support apparatus capable of fitting comfortably between a user's back and a seat surface; and b) a securing apparatus capable of holding the user's head wherein the support apparatus provides a rigid support when fitted between the user's back and the seat surface and the securing apparatus is capable of securing the user's head to the support apparatus.

In a preferred embodiment, the securing apparatus does not connect to the support apparatus in a downwardly directional manner. In another embodiment, the apparatus to connect the support apparatus to the securing apparatus is integral to the support apparatus. In another embodiment, the apparatus to connect the support apparatus to the securing apparatus is integral to the securing apparatus.

In one embodiment, the invention provides a head support wherein the securing apparatus comprises an eye blinder.

In one embodiment, the invention provides a head support device wherein the support apparatus comprises a hinge.

In one embodiment, the invention provides a head support device wherein the support apparatus comprises two rigid sides connected by a flexible material.

In one embodiment, the invention provides a head support device wherein the support apparatus comprises padding. In one embodiment, the padding is shaped to fit the contours of the human body.

In one embodiment, the support apparatus crosses over the shoulders of the user to the user's chest where it may be tethered by a tethering apparatus.

In one embodiment, the invention provides a head support device wherein the support apparatus comprises at least two different materials that may differ in rigidity.

In one embodiment, the invention provides a head support device wherein the support apparatus is shaped to conform to a seat shape.

In one embodiment, the invention provides a head support device comprising an attachment apparatus capable of attaching the support apparatus and the securing apparatus.

In one embodiment, the invention provides a head support device wherein the attachment apparatus is reversible.

In one embodiment, the invention provides a head support device wherein the attachment apparatus is Velcro.

In one embodiment, the invention provides a head support device wherein the attachment apparatus is a hooking apparatus.

In one embodiment, the invention provides a head support device wherein the securing apparatus is adjustable.

In one embodiment, the invention provides a head support device wherein the support apparatus is adjustably extendable.

In one embodiment, the invention provides a head support device wherein the support apparatus comprises a groove to accept the spinal column of the user.

In one embodiment, the invention provides a head support device wherein the support apparatus or the securing apparatus comprises a horseshoe shaped pillow.

In other embodiments, the invention provides the described inventive features in combination with other art known comfort devices including those having massage capability, temperature adjustment capability (i.e. hot or cold), sound blocking or amplifying capability, alarm/clock capability etc.

In one embodiment, the invention provides a method for providing head support for a user in need of such support, the method comprising utilizing the device described herein.

Figure 1B:
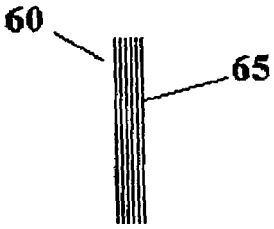
Figure 1C:
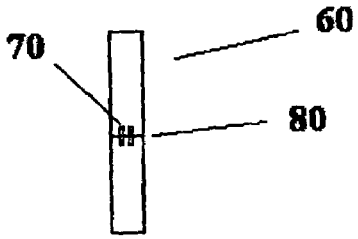
Figure 1D:
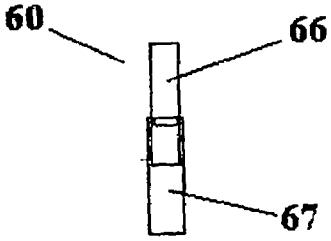
Figure 1E:
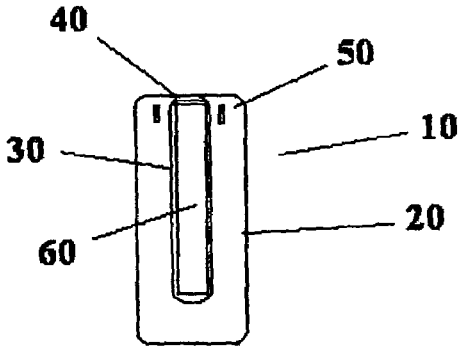

Referring to FIG. 1A, it can be seen by the drawing that the present invention may include a support apparatus cover 10 comprising a back piece 20, a pocket 30, a pocket opening 40 and attachment slots 50 and a rigid support 60. FIG. 1B depicts an alternative rigid support 60 comprising multiple rods 65. FIG. 1C depicts a rigid support comprising a cut 80 and a hinge 70, for example, a locking hinge. FIG. 1D depicts a rigid support 60 comprising a slotting piece 66 and a slotted piece 67 that enables the rigid support 60 to be reversibly extendible and compact. FIG. 1E depicts the present invention 10 with the rigid support comprised within the support cover.

Figure 2A:
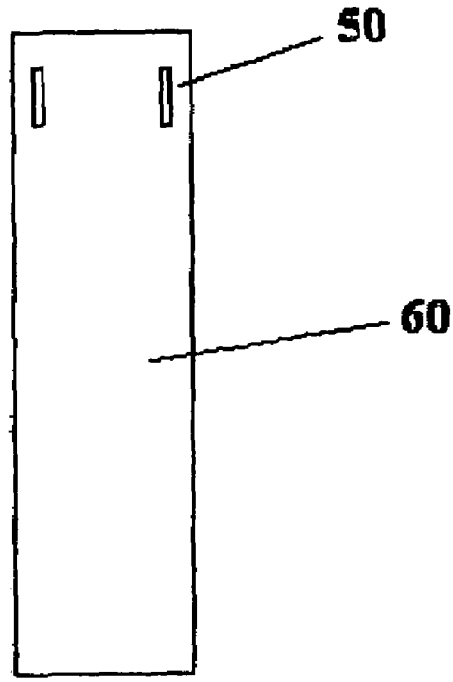
FIGS. 2A–B; presents views of the rigid support of the instant invention.
Figure 2B:
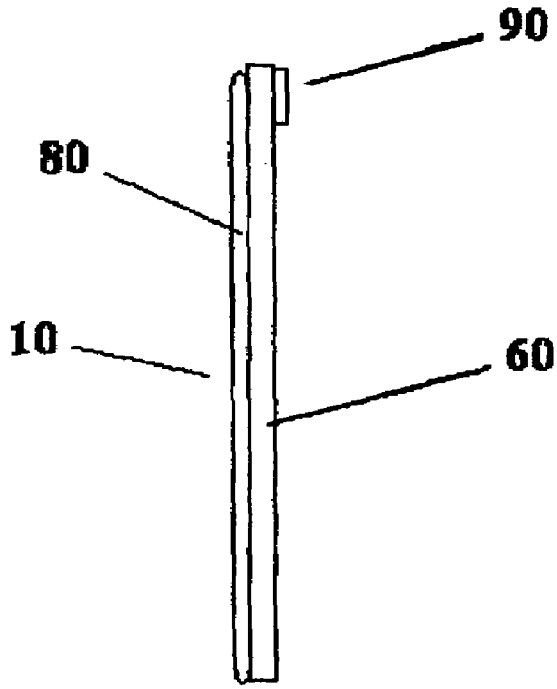

Referring to FIG. 2A, it can be seen in this front view that the rigid support 60 may itself comprise attachment slots 50 and may additionally include at least one hinge 70 to allow for folding and compact storage. FIG. 2B depicts a side view of the rigid support 60 wherein padding 80 and the attachment means 90 are visible.

Figure 3:
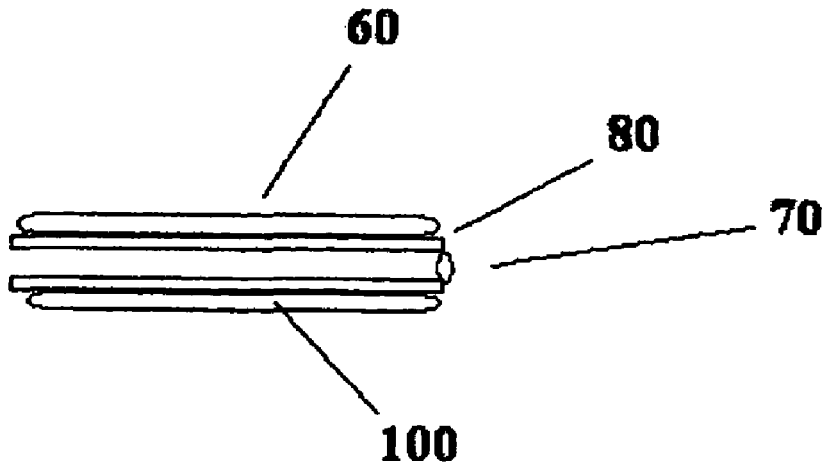
FIG. 3 is side view of the instant invention in a folded position.

Referring to FIG. 3, it can be seen by the drawing that in one embodiment of the present invention, the support apparatus can be folded when not in use.

Figure 4A:
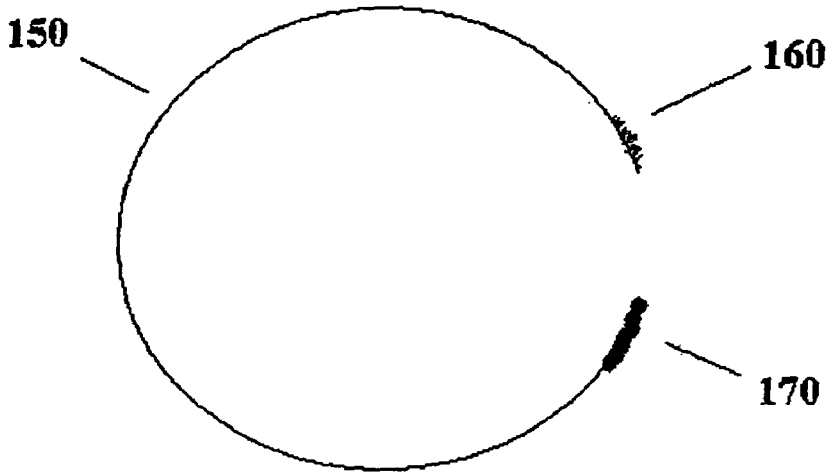
FIGS. 4A–C. presents views of the securing apparatus of the instant invention.
Figure 4B:
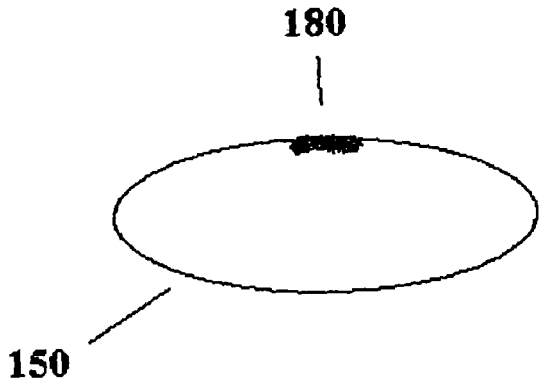
Figure 4C:
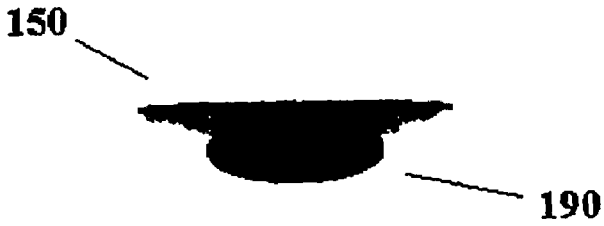

Referring to FIG. 4A, it can be seen from this top view schematic that the securing apparatus 150 may comprise material in a generally circular shape (i.e. approximately head shaped) and, for example, Velcro or another similarly functioning device 160/170 which allows the securing apparatus to be opened and threaded through attachment means on the support apparatus (not shown). FIG. 4B illustrates a top view of the securing apparatus 150 in a closed position with the sealed closure 180. FIG. 4C depicts one embodiment of the invention in which the securing apparatus 150 comprises an eye blinder piece 190.

Figure 5:
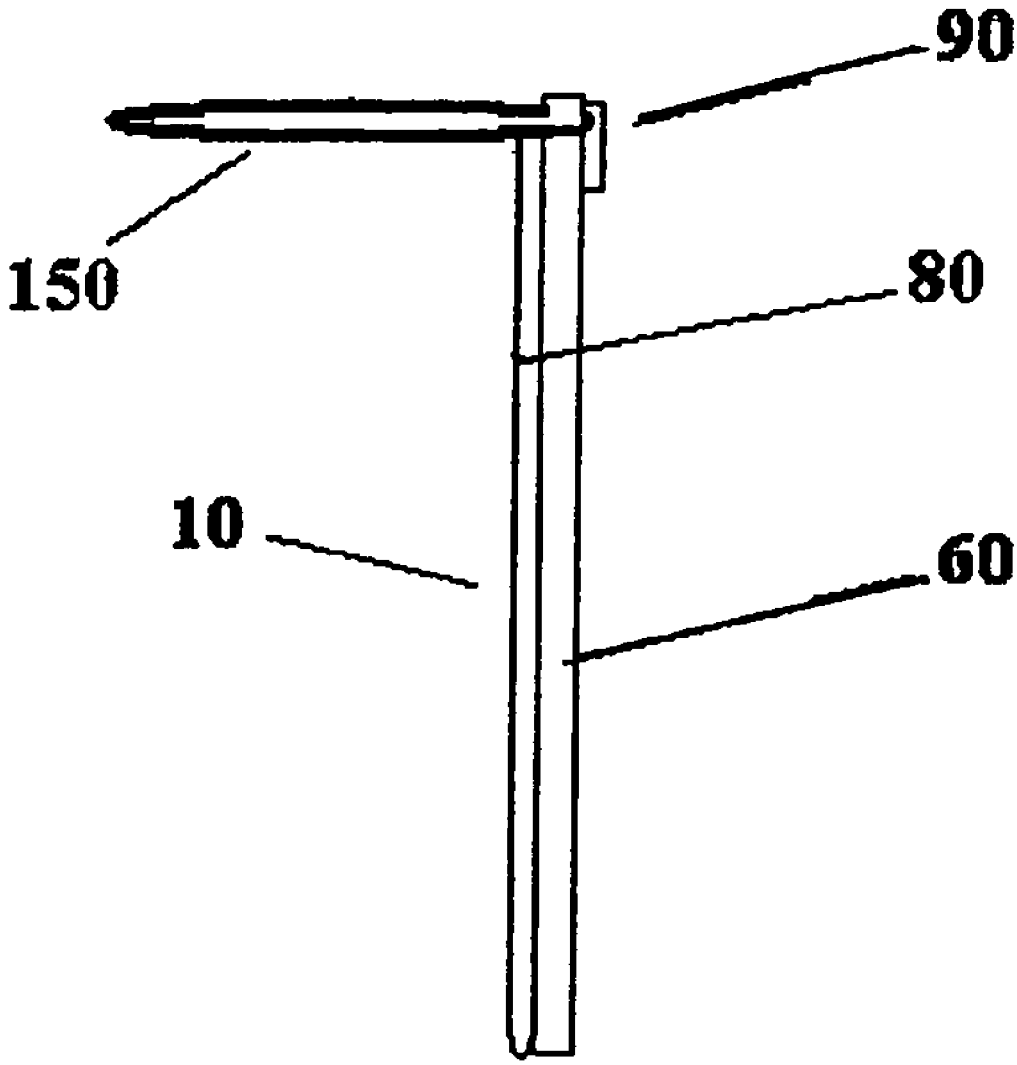
FIG. 5 is a side view of the device of the instant invention illustrating the support apparatus and securing apparatus.

FIG. 5 depicts a side view of the support apparatus 10 comprising the rigid support 60, padding 80, attachment means 90 and securing apparatus 150.

Figure 6:
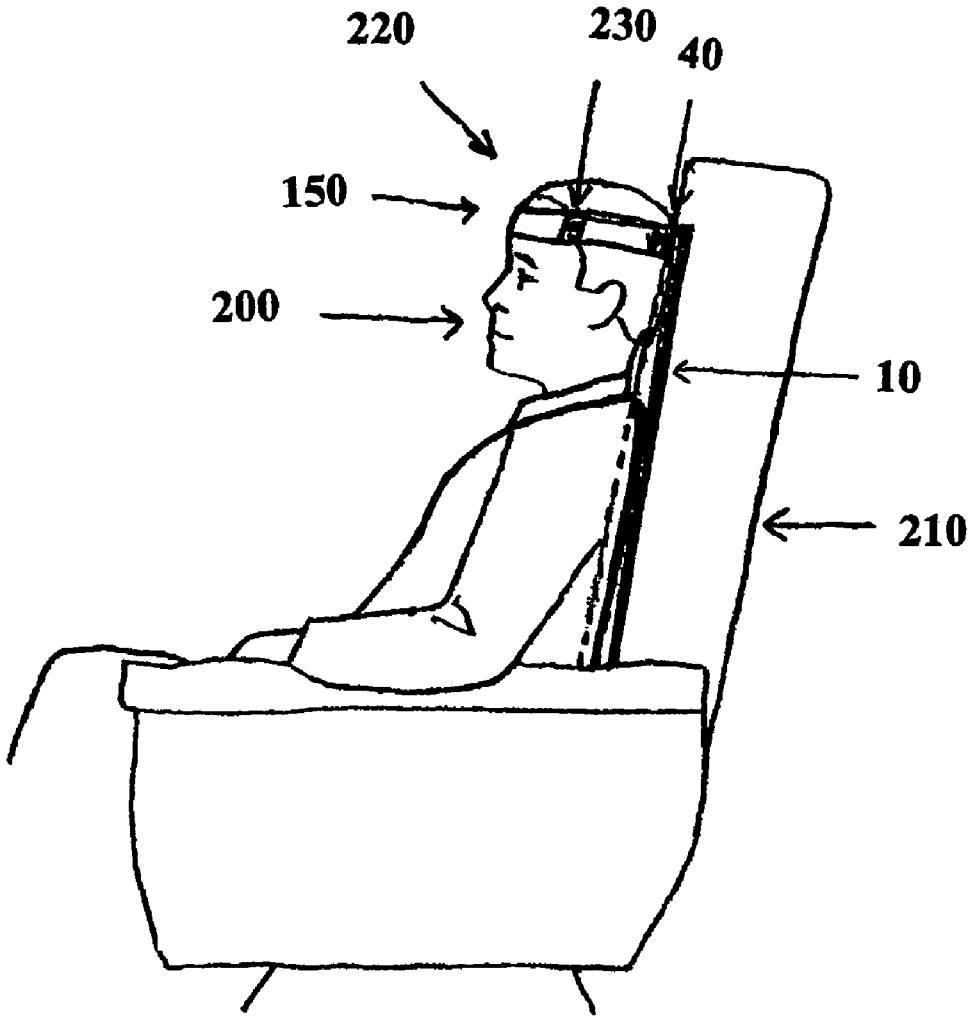
FIG. 6 is a view of the device being used by a user.

Referring to FIG. 6, it can be seen by the drawing that in one embodiment the user 200 leans back on the support apparatus 10 pressing it against the seat back 210. The securing apparatus 150 is wrapped around the user's head 220 and adjusted using the optional adjusting apparatus 230. The optional attachment apparatus 40 can be Velcro or another attachment apparatus that does not protrude uncomfortably from the support apparatus 10. Alternatively, the securing apparatus 150 may be threaded through slots on the support apparatus (not shown). For purposes of this illustration, the front of the seat back is shown with dashed lines such that the rigid support of the support apparatus 10 may be visualized.

Figure 7:
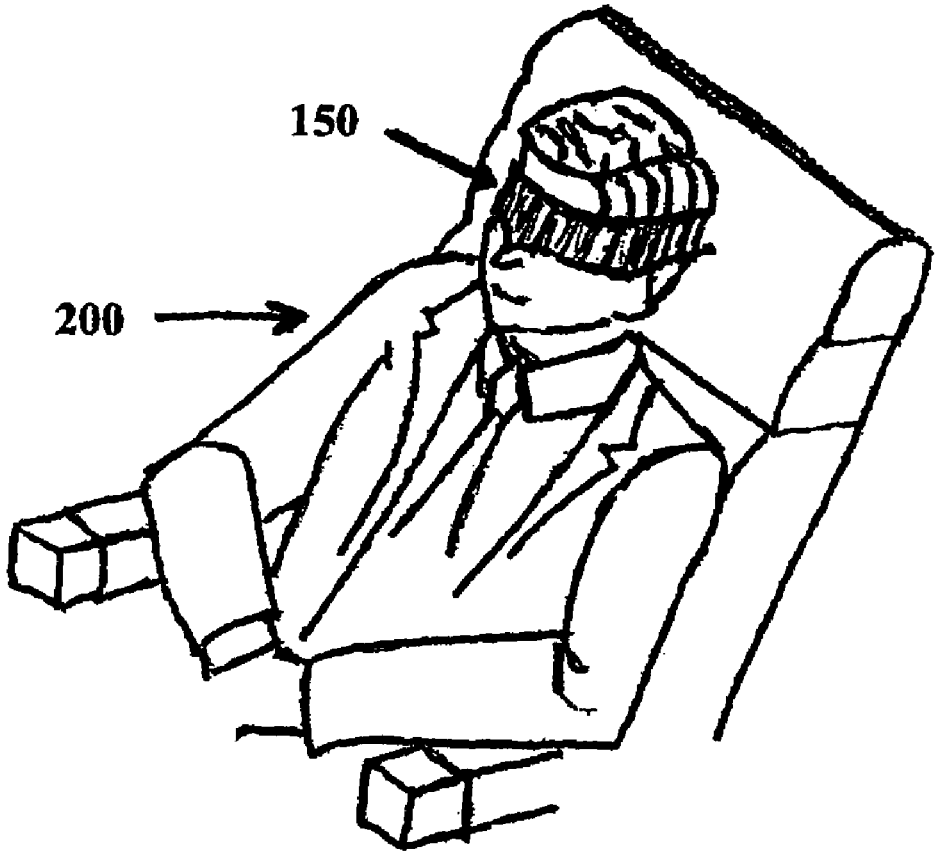
FIG. 7 is a further view of the device in use.

Referring to FIG. 7, it can be seen by the drawing that in one embodiment, the present invention is unobtrusive with only the securing apparatus 150 being substantially visible while the supporting apparatus is hidden behind the user 200.

Figure 8:
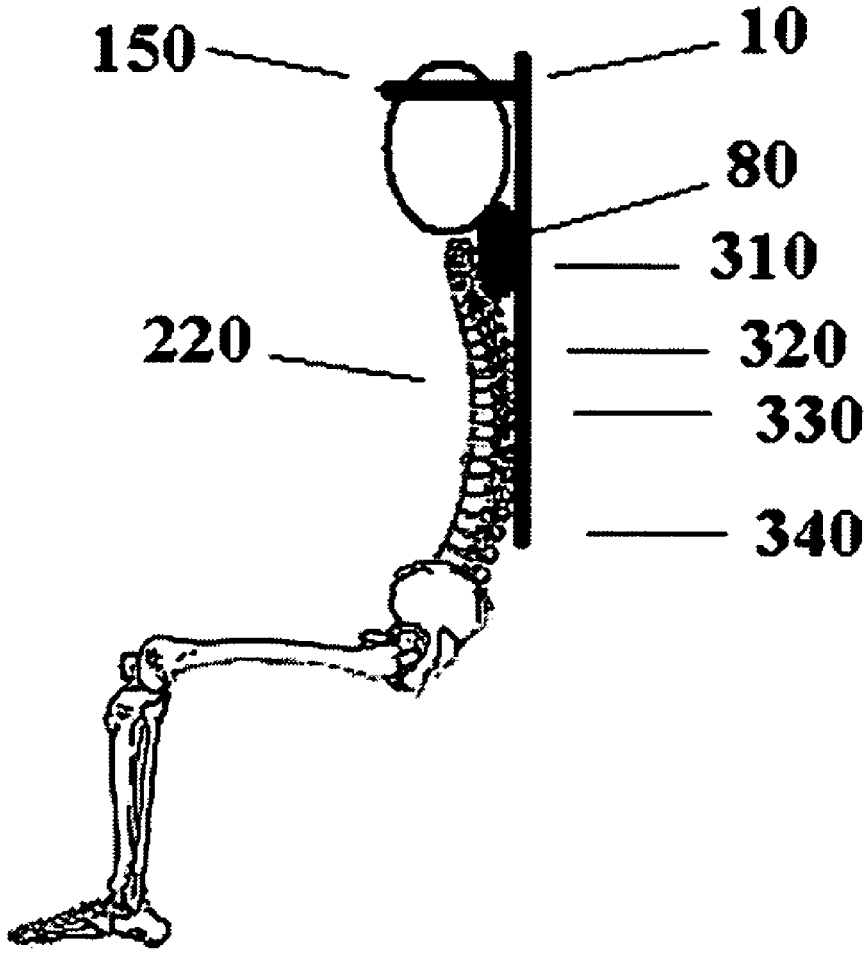
FIG. 8 is a side view of the human form juxtaposed with the device.

Referring to FIG. 8, it can be seen from this side view of the device in use that the device 10 may be fitted to the contours of the user 220. The securing means 150 circumnavigates the users head while the device 10 may be fitted to the various parts of the users neck and spine through, for example, padding 80. The device may be sized to fit or contour to the spine and the length of the device may allow it to extend down the length of the spine extending, for example, to the seven cervical vertebrae 310, the intervertebral disc 320, the twelve thoracic vertebrae 330 or the five lumbar vertebrae 340 or further.

Figure 9A:
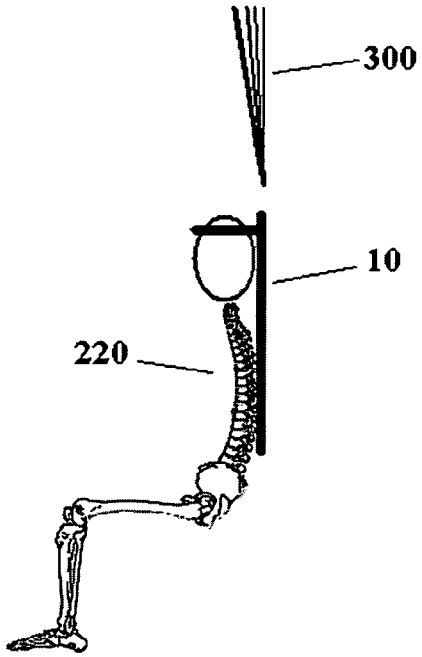
FIGS. 9A–B are side views of a seated form juxtaposed with different embodiments of the device (9A further illustrating device flexibility)
Figure 9B:
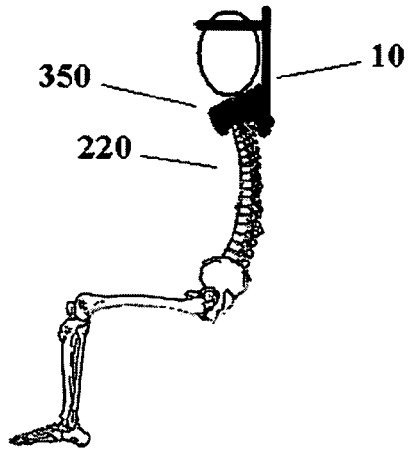

Referring to FIG. 9A, it can be seen from this side view of a seated user 220 that the device 10 may be engineered to flex over a defined range. In this figure, the flexibility of the device is designed such that the flexibility 300 is high over the initial range (represented by thin line), medium through the next range (represented by medium line) and low through final range (represented by thick line). Referring to FIG. 9B, it can be seen from this side view of a seated user 220 that the device 10 may be designed to integrate with a neck device (i.e. a horse shoe type pillow or other neck brace) 350. In this rendering, the support piece may be shortened as compared with that in FIG. 9A. This may also stabilize the securing member around the forehead, stopping any slippage of the user in the downward direction.

Figure 10A:
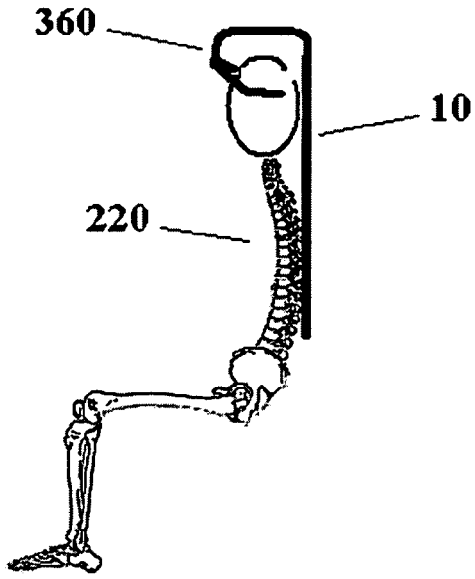
FIGS. 10A–B are side views of a seated form juxtaposed with a different embodiment of the device (10B simply illustrating the device)
Figure 10B:
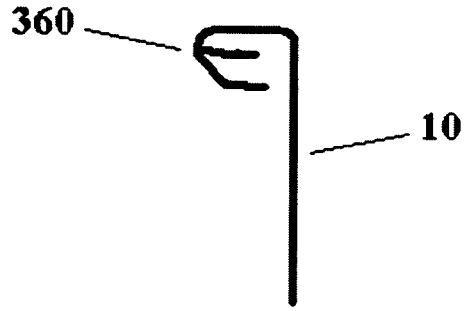

Referring to FIG. 10A, it can be seen from this side view of a seated user 220 that the device 10 may be engineered such that the securing member 360 bends over the top of the head and restrains the user from the forehead side. Referring to FIG. 10B, the securing member 360 and device 10 are shown.

Figure 11:
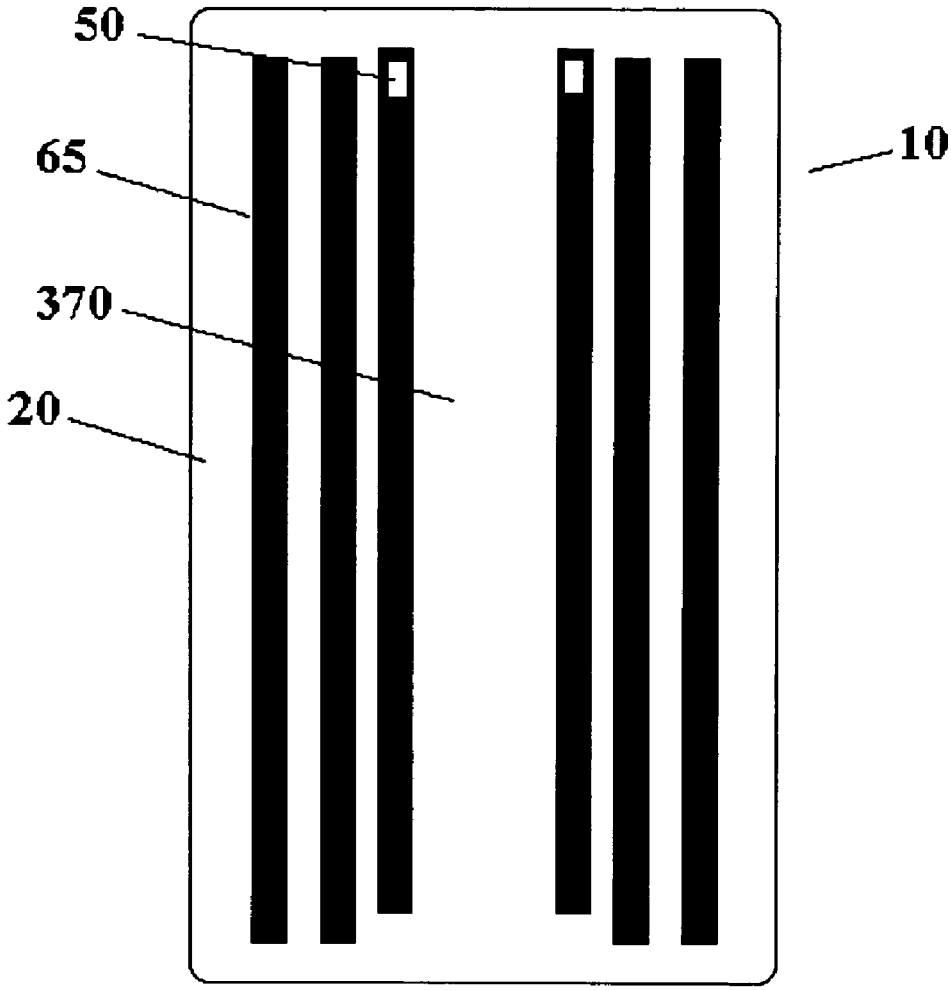
FIG. 11 presents a view of one embodiment of the device in which a flexible and/or soft groove is present in the middle.

Referring to FIG. 11, it can be seen from this front view that the device 10 may be designed such that multiple segments 65 are comprised within a soft shell 20. A slotting hole 50 is present for receiving the securing piece (not pictured). A flexible and/or soft middle area 370 is present for comfortably meeting the user's spine.

The invention is further described in the following examples that are merely included for illustrative purposes and are not intended to limit the scope of the claims in any way.

EXAMPLE 1

A rigid support comprising $\frac{1}{8}^{th}$ inch thick acrylic was fabricated to be 4 inches wide and 16 inches long. The support was covered with two layers of 3 mm neoprene. The attachment apparatus was fabricated by gluing a 3-inch wide strip of neoprene to the back of the support at the upward portion to form a "belt-loop" structure. The securing apparatus was made by first cutting a strip of sailcloth approximately 2 inches wide and 24 inches long. Velcro was affixed to the ends. The strip was cut in half in the middle and a 2-inch piece of elastic was attached to connect the two pieces back together. A headpiece/eye mask was fabricated from fleece such that the strip of sailcloth could be threaded through the headpiece where it meets the user's forehead. The eye mask portion can be folded up or down when the device is in use.

The sailcloth was threaded through the "belt loop" on the back of the support device and the ends were attached by the Velcro such that the securing apparatus comfortably but snugly circumnavigated the user's forehead.

EXAMPLE 2

A rigid support consisting of $\frac{1}{8}^{th}$ inch thick acrylic was fabricated to be 4 inches wide and 12 inches long. A support cover was fabricated of nylon and fleece with a pocket sized to fit the acrylic support. The support cover extended 4 inches below the bottom of the rigid support when the rigid support was placed in the support cover pocket. The attachment apparatus was fabricated by putting slots on either side of the top of the cover piece such that the securing apparatus could be threaded through the slots. The securing apparatus was made by first cutting a strip of sailcloth approximately 2 inches wide and 24 inches long. Velcro was affixed to the ends. The strip was cut in half in the middle and a 2-inch piece of elastic was attached to connect the two pieces back together. A headpiece/eye mask was fabricated from fleece such that the strip of sailcloth could be threaded through the headpiece where it meets the user's forehead. The eye mask portion can be folded up or down when the device is in use.

The sailcloth was threaded through the slots on the back of the support device and the ends were attached by the Velcro such that the securing apparatus comfortably but snugly circumnavigated the user's forehead.

EXAMPLE 3

A rigid support consisting of $4\frac{1}{8}^{th}$ inch thick acrylic pieces was glued to a piece of neoprene approximately 8 inches wide. The pieces were spaced according to FIG. 11. A second piece of neoprene, identical in size to the first piece, was glued such that a sandwich was created with the rigid support disposed in between the two neoprene pieces. The attachment apparatus was fabricated by cutting slots through the neoprene near the top such that the securing apparatus could be threaded through the slots. The securing apparatus was made by first cutting a strip of sailcloth approximately 2 inches wide and 24 inches long. Velcro was affixed to the ends. The strip was cut in half in the middle and a 2-inch piece of elastic was attached to connect the two pieces back together. A headpiece/eye mask was fabricated from fleece such that the strip of sailcloth could be threaded through the headpiece where it meets the user's forehead. The eye mask portion can be folded up or down when the device is in use.

While the invention has been described with regard to the specific embodiments, those skilled in the art will recognize that changes can be made in form and detail without departing from the spirit and scope of the invention. Further, while certain combinations of elements have been described, alternative combinations of the described elements are also envisioned.

I claim:

1. A head support device comprising a) a support member adapted to be disposed between a user and a seat surface;

b) a securing member capable of restraining the user's head; and c) an attachment apparatus capable of attaching the support member and the securing member wherein the support apparatus provides a resilient support when disposed between the user and the seat surface, and the securing means is capable of securing the user's head to the support apparatus, wherein the securing means secures the user's head to the support apparatus at a position behind the user's head, wherein the attachment apparatus enables reversible attachment and wherein the device is not secured to the user at any point lower than the user's chin.

2. The head support device according to claim 1, configured such that the support member fits comfortably between the user's back or side and the seat surface.

3. The head support device according to claim 1, wherein the securing member further comprises an eye blinder.

4. The head support device according to claim 1, wherein the support member comprises a compacting apparatus which allows the support member to be made more compact.

5. The head support device according to claim 1, wherein the support member comprises padding.

6. The head support device according to claim 1, wherein the support member comprises at least two different materials of differing rigidity.

7. The head support device according to claim 1, wherein the support member is shaped to substantially conform to a seat shape.

8. The head support device according to claim 1, wherein the support member comprises a groove to comfortably conform to the spinal column of the user.

9. The head support device according to claim 1, wherein the device comprises a horseshoe shaped pillow positioned such that it accommodates the user's neck.

10. The head support device according to claim 1, wherein the support member comprises more than one segment.

11. The head support device according to claim 1 wherein the securing member maintains the user's head in a substantially vertical position when the user is seated.

12. The head support device according to claim 1 wherein the securing member supports the user's head at a point above the nose thereby relieving at least some stress on the user's neck and/or shoulders.

13. The head support device according to claims 1 wherein the securing member maintains the user's head in a position which facilitates sleep.

14. The head support device according to claim 1, wherein the device restrains the user's head such that the back of the head remains within six inches of the firm surface when the user's neck is relaxed.

15. The head support device according to claim 1, wherein the resiliently flexible support member has a rigidity approximately equal to acrylic that is $1/8^{th}$ of an inch thick and four inches wide.

16. A method of supporting a user's head when seated, comprising the steps of:

providing the support device according to claim 1;

positioning the support member between the user and a seat;

trapping the support member between the user and the seat when the user is seated; and securing the securing member around the user's head.

* * * * *